US006634123B1

(12) United States Patent
Bradley et al.

(10) Patent No.: US 6,634,123 B1
(45) Date of Patent: Oct. 21, 2003

(54) DEVICE FOR WAVING A FLAG AND BANNER

(76) Inventors: William P. Bradley, 311 E. 23rd St., New York, NY (US) 10001; William Z. Sloan, 15 E. Kingsbridge Rd., Bronx, NY (US) 10468

( * ) Notice: Subject to any disclaimer, the term of this patent is extended or adjusted under 35 U.S.C. 154(b) by 28 days.

(21) Appl. No.: 10/097,506

(22) Filed: Mar. 13, 2002

(51) Int. Cl.[7] ..... G09F 17/00
(52) U.S. Cl. ..... 40/214; 116/173
(58) Field of Search ..... 40/214; 116/173

(56) References Cited

U.S. PATENT DOCUMENTS 2,302,524 A 11/1942 Borregard
3,995,580 A 12/1976 Serrone
4,461,234 A 7/1984 Bounds
5,450,811 A 9/1995 Heiland
5,692,328 A 12/1997 Pettit

*Primary Examiner*—Cassandra H. Davis
(74) *Attorney, Agent, or Firm*—Richard L. Miller

(57) ABSTRACT

A device for waving a banner which utilizes an electric motor mounted in a housing and having a simple attachment spring mechanism secured to an output shaft so that a flag staff or banner staff can be easily attached or detached therefrom. Accordingly when the flag is attached in this manner and the motor is energized the flag is rotated and appears to wave so that all may observe. A user accessible switch is provided so that the device can be easily activated and deactivated by the user.

6 Claims, 1 Drawing Sheet

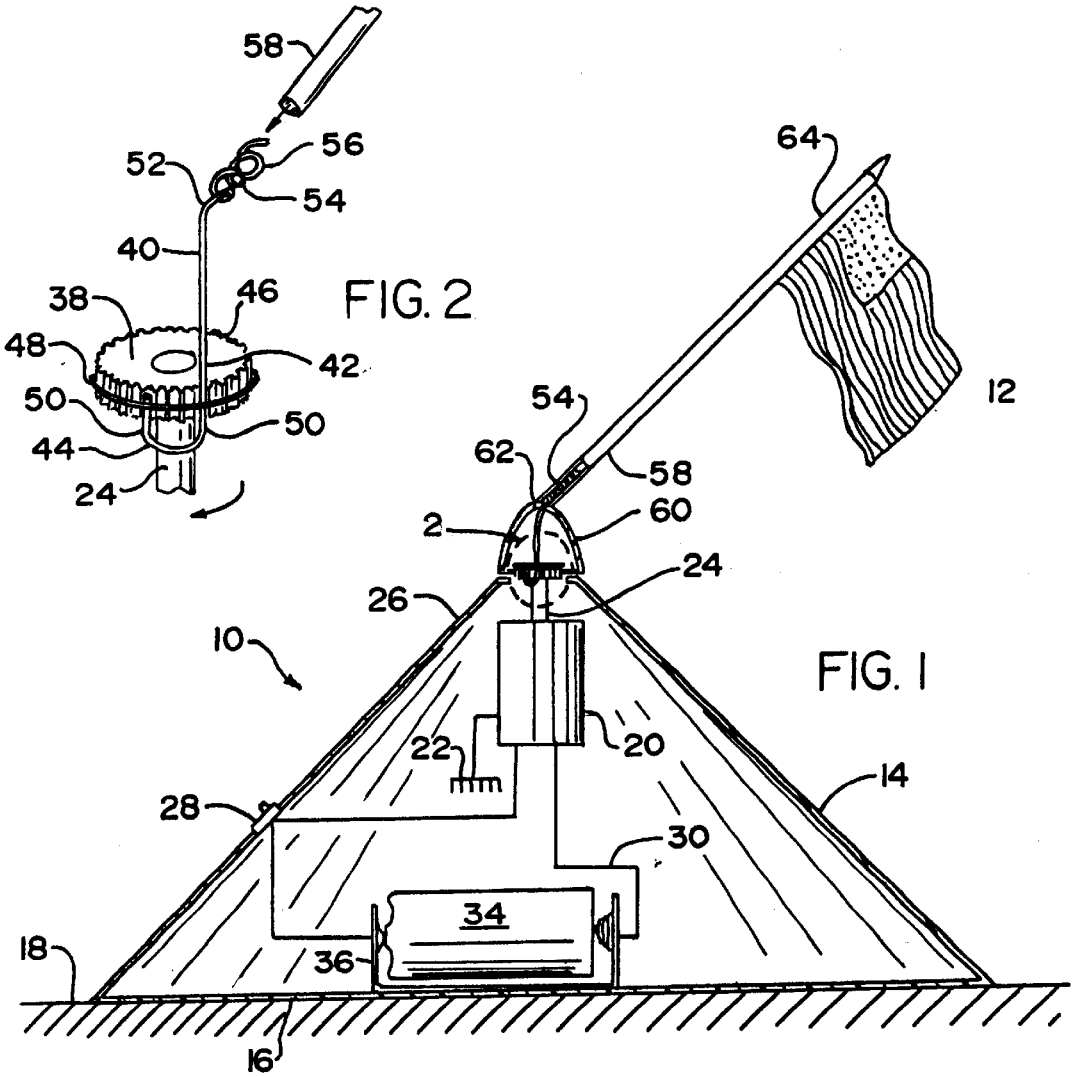
FIG. 2
FIG. 1
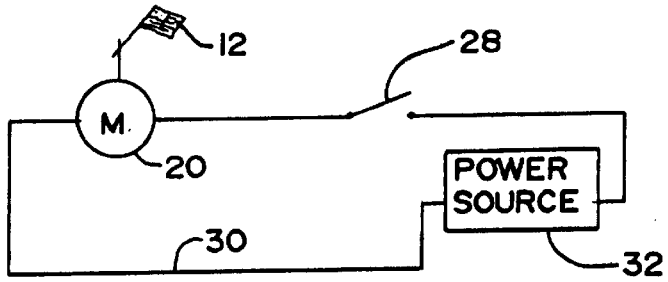
FIG. 3

DEVICE FOR WAVING A FLAG AND BANNER

BACKGROUND OF THE INVENTION

1. Field of the Invention

The present invention relates to a device for waving a flag or banner.

2. Description of the Prior Art

Numerous innovations for displaying a flag or the like in waving condition have been provided in the prior art that will be described. Even though these innovations may be suitable for the specific individual purposes to which they address, accordingly they differ from the present invention.

A FIRST EXAMPLE, U.S. Pat. No. 2,302,524 to Borregard teaches in an approved device for simulating the waving of a flag or banner, the combination of a staff, a flag or banner having the hoist thereof attached to the staff, a resilient rod having its upper end attached to the upper outer corner of the flag or banner, means for attaching the lower end of said rod to a plunger armature, a solenoid, means associated with the solenoid for resiliently attaching the plunger armature in operative relation to the solenoid, an energizing circuit for said solenoid, and means for intermittently energizing the solenoid to impart a reciprocating motion to the plunger armature and whereby an oscillatory movement will be imparted to the upper end of the said rod and to thereby impart a waving motion to the upper end of the flag or banner, and which motion will be transmitted to the entire flag or banner and simulate the waving motion of a flag or banner in a breeze.

A SECOND EXAMPLE, U.S. Pat. No. 3,995,580 to Serrone teaches a device is provided for displaying a flag or the like in waving condition, wherein such condition is produced or simulated by mechanical means, rather than by the effects of air currents. The device employs a rotatably supported pole, to which one edge of the flag is secured; a support element, to which another edge of the flag is secured, extending laterally from the pole and rotatable with the latter; and drive means for oscillating the pole about its axis through an angular rotation of less than 90 degrees.

A THIRD EXAMPLE, U.S. Pat. No. 4,461,234 to Bounds teaches a flag waving machine for automatically waving a flag in a FIG. 8 pattern. A rod provides a support for the flag to be waved, this rod being attached to a pitman arm through a universal joint, the rod being pivotally supported in a bushing. The pitman arm is rotatably driven at one end to provide reciprocal motion of the rod, this reciprocal motion being guided in a FIG. 8 pattern by means of a guide channel. The channel is formed between a FIG. 8 shaped wall formed on a base member and a pair of spring-urged elliptical guide members which are also shaped and positioned to form a FIG. 8, the guide members operating to guide the path of the arm in the channel through a FIG. 8 pattern.

A FOURTH EXAMPLE, U.S. Pat. No. 5,450,811 to Heiland teaches a signalling device for warning motorists of danger including, in combination: a planar sign having a first surface with indica thereon; a housing having a top wall with a slot formed therein and a flange secured to the sign; a motor positioned within the housing, the motor having a horizontal output shaft, a disk coupled to the output shaft, the disk adapted for rotational movement, and a hole formed within the periphery of the disk; a generally vertically extending flag pole having an upper extent and a lower extent, the lower extent being pivotally connected to the bottom wall of the housing, the flag pole adapted for cyclic pivotal movement, a horizontal hole formed adjacent to the lower extent of the flag pole, the flag pole being positioned such that it extends through the slot of the housing, the upper extent of the flag pole extending above the housing and the top portion of the sign; an s-shaped pin having a first end and a second end, the first end positioned within the hole formed adjacent to the lower extend of the flag pole, the second end positioned within the hole of the disk, the pin adapted to translate the rotational movement of the disk into the cyclical pivotal movement of the flag pole.

A FIFTH EXAMPLE, U.S. Pat. No. 5,692,328 to Pettit teaches an apparatus for displaying a flag, banner, or pennant, so as to simulate waving in wind, is particularly adapted for use with a novelty flag that is scaled for use in model railroad layouts. The apparatus employs a correspondingly scaled flag staff for coupling with and supporting the flag along one edge thereof. A drive arrangement is coupled to the flag staff at the base thereof for producing a rotatory oscillating motion. Electrical energy for the drive arrangement, which includes a small electric motor having a motor shaft with an eccentric element attached thereto, is provided from a conventional energy source, such as batteries. Coupling between the flag staff and the drive arrangement is achieved via a mechanical energy storage device that includes a resilient spring arranged to receive mechanical energy from the drive arrangement. The eccentric element attached to the motor shaft includes a mechanical striker that is in the form of a spring wire wound about the motor shaft. Mechanical energy stored in the mechanical energy storage device is delivered to the flag staff via a drive coupler that is coupled to the mechanical energy storage arrangement. The mechanical energy received by the mechanical energy storage arrangement is converted to the rotational oscillatory, motion of the flag staff, the rotational oscillations being of such frequency and amplitude to induce an undulation in the novelty flag, whereby the flag is raised from its draped orientation so as to extend outwardly, giving the appearance of being supported by the wind.

SUMMARY OF THE INVENTION

AN OBJECT of the present invention is to provide a device for waving a banner that avoids the disadvantages of the prior art.

ANOTHER OBJECT of the present invention is to provide a device for waving a banner that is simple and inexpensive to manufacture.

STILL ANOTHER OBJECT of the present invention is to provide a device for waving a banner that is simple to use.

BRIEFLY STATED, STILL YET ANOTHER OBJECT of the present invention is to provide a device for waving a banner which utilizes an electric motor mounted in a housing and having a simple spring mechanism secured to an output shaft so that a flag staff or banner staff can be easily attached or detached therefrom. Accordingly when the flag is attached in this manner and the motor is energized the flag is rotated and appears to wave so that all may observe.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 1 is a diagrammatic elevational side view partially in section of the present invention;

FIG. 2 is an enlarged diagrammatic perspective view of the area enclosed in the dotted curve indicated by arrow 2 in FIG. 1; and FIG. 3 is an electrical schematic thereof.

A MARSHALLING OF REFERENCE UTILIZED IN THE DRAWING

10 device for waving a flag and banner 12
12 flag and banner
14 housing
16 bottom surface
18 surface
20 motor
22 securement symbol
24 rotatable output shaft
26 top apex of the housing 14
28 optional on-off electrical switch
30 series loop
32 power source
34 a battery or batteries
36 battery box
38 gear
40 attachment component
42 first end of the attachment component 40
44 U-shaped portion
46 gear's teeth
48 elastic torus or band
50 both arms of U-shape portion
52 second end of the attachment component 40
54 helical spring
56 helical convolution of the helical spring 54
58 tubular flag staff
60 spinner
62 apex of spinner 60
64 flag staff

DETAILED DESCRIPTION OF THE PREFERRED EMBODIMENT

Referring now to the figures, in which like numerals indicate like parts, and particularly to FIG. 1, a device 10 for waving a flag and banner 12 has a housing 14 which maybe either a pyramid shape or a cone shape and a bottom surface 16 for standing upon a surface 18. A motor 20 is attached to and within the housing 14 by any well known manner as indicated by securement symbol 22 with a rotatable output shaft 24 extending out of a top apex 26 of the housing 14.

Mounted in a user accessible location protruding through an exterior surface of the housing is an optional on-off electrical switch 28 which is connected in a series loop 30 with the electrical input of the motor 20 and a power source 32, for energizing and de-energizing the motor 20, as best seen in the electrical schematic of FIG. 3, and cross sectional view of FIG. 1. The power source 32 may be a battery or batteries 34 as shown in FIG. 1 connected utilizing a well known connecting mechanism, typically a battery box 36, or alternatively the soldering of connections directly thereto. Alternatively the power source may also be accomplished by provisioning the device with an electrical plug not shown for inserting in a residential 115 volt AC electrical socket. Naturally properly rated electrical components must be chosen for whatever design choice of power source is to be utilized in a particular embodiment of the invention.

As best seen in FIG. 2, the motor's rotatable output shaft 24 has fixedly secured thereto a gear 38 so that an attachment component 40 may be easily removably attached thereto. The attachment component 40 has a first end 42 with a U-shaped portion 44 integrally formed therewith. The U-shaped portion 44 is placed abutting the teeth 46 of gear 38 and an elastic torus or band 48 is streched or tightly fitted around the gear's teeth 46 capturing both arms 59 of U-shape portion 44 between the teeth 46 of gear 38 effectively securing the first end 42 of attachment component 40 to the gear 38 so that the entire assembly rotates as a single unitary component. This mechanism permits the attachment component 40 to be quickly and easily attached and removed from the gear 38 when it is desired to substitute one attachment component 40 for another.

A second end 52 of the attachment component 40, has a helical spring 54 integrally formed therewith and with the axis thereof tipped at an angle of approximately 45 degrees with respect to the arms 50 of the U-shape portion 44. A first end of an appropriate sized tubular flag staff 58 can cooperate with the helical convolutions 56 of the helical spring 54 and retained thereby so that when the motor's rotatable output shaft 24 it rotated the flag 12 rotates therewith and appears to have a waving motion that all viewers may observe. Naturally the RPM of the motor's output shaft has to be chosen in an appropriate ranges typically 1 to 60 rpm, but in any case commensurate with the general size of the device. A spinner 60, which cooperates with gear 38, can be placed over the attachment component 40 with the helical spring 54 exiting from an apex 62 thereof before the tubular flag staff 58 is engaged with the helical convolutions 56 of helical spring 54 so as to present a more streamlined appearance. It is to be further noted that should the flag 12 inadvertently come in contact with a foreign object that the attachment component 40 prevents the tubular flag staff 64 from imparting a severe force to such a foreign object because the attachment component 40 along with the helical spring 54 will flex under such condition. Should the staff somehow become entangled with a foreign object the attachment component will be caused to separate from the gear 38 and accordingly prevent damage or injury from occurring.

It will be understood that each of the elements described above, or two or more together, may also find a useful application in other types of constructions differing from the types described above.

While the invention has been illustrated and described as embodiments of a device for waving a banner or flag, accordingly it is not limited to the details shown, since it will be understood that various omissions, modifications, substitutions and changes in the forms and details of the device illustrated and its operation can be made by those skilled in the art without departing in any way from the spirit of the present invention. It is to be further understood that the terms flag and banner are used through out this disclosure indiscriminately and accordingly structurely are identical.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for waving a flag and banner comprising:

a) a motor for supplying rotative motion to move said flag;

b) a power source for energizing said motor;

c) a means for attaching said flag to an output shaft of said motor; and d) a housing for containing said motor, said power source, and supporting said device upon a surface, wherein said housing further comprises: a shape of said housing selected from the group consisting of a pyramid and a cone; wherein said motor has an output shaft which extends out of a top of an apex of said group; and wherein said output shaft has a gear fixedly secured thereto, wherein said means for attaching said flag to said shaft of said motor further comprises an attachment component, with a first end, having a U-shaped portion which is placed abutting teeth of said gear and secured thereto by tightly fitting an elastic torus therearound and capturing both arms of said U-shaped portion between said teeth of said gear, and a second end having a helical spring integrally formed therewith so that a staff of said flag can cooperate with the convolutions of said helical spring.

2. The device as defined in claim 1, wherein said power source has an on-off electrical switch connected in a series loop with an electrical input of the motor, for energizing and de-energizing the motor.

3. The device as defined in claim 2, wherein said on-off electrical switch resides in an user accessible location.

4. The device as defined in claim 3, which further comprises: a spinner which cooperates with said gear and can be placed over the attachment component with the helical spring exiting from an apex of said spinner, so as to present a streamlined appearance.

5. The device as defined in claim 4, wherein said power source is at least one battery self-contained within said housing.

6. The device as defined in claim 4, wherein said power source is an electrical plug for inserting in a residential 115 volt AC electrical socket.

* * * * *